US010663216B2

(12) United States Patent
Ding et al.

(10) Patent No.: US 10,663,216 B2
(45) Date of Patent: May 26, 2020

(54) REFRIGERATION APPLIANCE AND DOOR FOR REFRIGERATION APPLIANCE

(71) Applicant: BSH HAUSGERAETE GMBH, Munich (DE)

(72) Inventors: Yulei Ding, Nanjing (CN); Zhishan Lu, Chuzhou (CN); Xuehua Mao, Nanjing (CN); Chuan Zhang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/093,984

(22) PCT Filed: Mar. 22, 2017

(86) PCT No.: PCT/IB2017/051665
§ 371 (c)(1),
(2) Date: Oct. 16, 2018

(87) PCT Pub. No.: WO2017/208086
PCT Pub. Date: Dec. 7, 2017

(65) Prior Publication Data

US 2019/0113269 A1 Apr. 18, 2019

(30) Foreign Application Priority Data

Jun. 1, 2016 (CN) ..... 2016 1 0380811

(51) Int. Cl.
*A47B 96/04* (2006.01)
*F25D 23/02* (2006.01)
(Continued)

(52) U.S. Cl.
CPC ..... *F25D 23/028* (2013.01); *E06B 3/72* (2013.01); *E06B 5/00* (2013.01); *F25D 23/082* (2013.01); *F25D 2323/02* (2013.01)

(58) Field of Classification Search
CPC .... F25D 23/028; F25D 2323/02; A47F 3/043; A47F 3/0434
See application file for complete search history.

(56) References Cited

U.S. PATENT DOCUMENTS

2013/0019616 A1* 1/2013 Reichert ..... A47F 3/0434 62/80
2014/0203699 A1* 7/2014 Pack ..... A47F 3/0434 312/405

(Continued)

FOREIGN PATENT DOCUMENTS

CN 103615859 A 3/2014
CN 105066568 A 11/2015

(Continued)

*Primary Examiner* — Matthew W Ing
(74) *Attorney, Agent, or Firm* — Laurence A. Greenberg; Werner H. Stemer; Ralph E. Locher

(57) ABSTRACT

A refrigeration appliance and a door for a refrigeration appliance. The door includes an inner door-wall, a door plate and a side cover. The side cover includes a first cover member and a second cover member bonded along a length direction of the side cover. A connecting structure connects the first cover member and the second cover member. The connecting structure includes at least two slots and at least two insert portions inserted into the matching slots in the length direction of the side cover. The at least two insert portions include a first insert portion and a second insert portion perpendicular to each other. Accordingly, the first cover member and the second cover member are connected conveniently, and connecting stability and firmness are achieved.

17 Claims, 5 Drawing Sheets

(51) Int. Cl.

| | |
|---|---|
| ***F25D 23/08*** | (2006.01) |
| ***E06B 3/72*** | (2006.01) |
| ***E06B 5/00*** | (2006.01) |

(56) References Cited

U.S. PATENT DOCUMENTS

| | | | | |
|---|---|---|---|---|
| 2016/0073792 | A1* | 3/2016 | Bouwman | A47F 3/0434 312/116 |
| 2018/0112906 | A1* | 4/2018 | Yi | F25D 23/02 |
| 2019/0221144 | A1* | 7/2019 | Artwohl | A47F 3/001 |
| 2019/0261785 | A1* | 8/2019 | Artwohl | A47F 3/0434 |

FOREIGN PATENT DOCUMENTS

| | | | |
|---|---|---|---|
| DE | 102010028414 | A1 | 11/2011 |
| EP | 2405216 | A1 | 1/2012 |
| EP | 2889566 | A1 | 7/2015 |
| JP | S61127390 | U | 8/1986 |

* cited by examiner

REFRIGERATION APPLIANCE AND DOOR FOR REFRIGERATION APPLIANCE

BACKGROUND

Technical Field

The present invention relates to the technical field of refrigeration appliances, and in particular, to a refrigeration appliance and a door for a refrigeration appliance.

Related Art

Appearances of doors for refrigerators have been becoming diverse. Plastic is characterized by being used to form any shape and any curved surface, and therefore is applied to manufacture of doors, to make appearances of the doors become more diverse.

When a door is relatively long, a side cover of the door may be formed by connecting at least two parts. That is, each part is manufactured independently and then the parts are installed together, to ensure mold and injection manufacturability and consistency of appearance processing.

How to make multiple parts of a cover member connected easily and accurately is one of technical problems confronting persons skilled in the art.

SUMMARY

A problem to be resolved in the present invention is to provide a door for a refrigeration appliance whose door has a side cover with connecting stability and desirable firmness, thereby resolving at least one technical problem in the prior art.

To resolve the foregoing problem, the present invention provides a door for a refrigeration appliance. The door includes an inner door-wall, a door plate in front of the inner door-wall, and a side cover. The side cover includes a first cover member and a second cover member bonded along a length direction of the side cover. The door includes a connecting structure for connecting the first cover member and the second cover member. The connecting structure includes at least two slots and at least two insert portions inserted into the matching slots in the length direction of the side cover. The at least two insert portions include a first insert portion and a second insert portion perpendicular to each other.

During assembly, the first cover member and the second cover member are operated to be connected by inserting the insert portions into the matching slots, and the first cover member and the second cover member are not readily separated in the length direction of the side cover. On the one hand, the inserting manner is easy to operation, and the first cover member and the second cover member can be connected quickly, improving assembly efficiency.

On the other hand, the first insert portion and the second insert portion are arranged to be perpendicular to each other. When such two types of insert portions are inserted into the matching slots, the first insert portion and the second insert portion can be limited in the corresponding slots along a front-and-back direction and a width direction of the door respectively, so that the first cover member and the second cover member are not prone to move in relation to each other in the front-and-back direction and the width direction of the door and are limited by each other. Due to these factors, the first cover member and the second cover member both have desirable connecting stability and are not prone to shake in relation to each other in the front-and-back direction and the width direction of the door.

It should be understood that, the length direction of the side cover is the width direction of the door when the side cover is disposed along the width direction of the door, and the length direction of the side cover is a height direction of the door when the side cover is disposed along the height direction of the door. The present invention is applied to a case in which the side cover is disposed along the width direction of the door or along the height direction of the door.

Optionally, the first cover member and the second cover member separately include sidewall portions for forming corresponding parts of one sidewall of the door, and connecting portions that extend towards another sidewall of the door and that are connected to the door plate or the inner door-wall. The first insert portion and the second insert portion are respectively parallel to the sidewall portion and the connecting portions of the first cover member or visa verse.

In this way, the first insert portion may be limited in the matching slot desirably along the front-and-back direction of the door, and the second insert portion may be limited in the matching slot desirably along the width direction of the door. Therefore, the first cover member and the second cover member can be limited by each other along the front-and-back direction and the width direction of the door plate and are not prone to shake in relation to each other.

Optionally, the first insert portion and the second insert portion are connected to each other and are respectively inserted into a first slot, and a second slot; and the first slot and the second slot are in communication with and perpendicular to each other. In this way, manufacture of molds can be simplified and manufacturing efficiency can be improved.

Optionally, the at least two slots include a third slot adjacent to the first insert portion or the second insert portion. In this way, a limit position can be formed in the front-and-back direction or the width direction of the door, and connecting stability of the first cover member and the second cover member can be enhanced.

Optionally, the first cover member or the second cover member includes at least two second insert portions, and the at least two slots include a third slot located between the at least two second insert portions. In this way, multiple limit positions can be formed in the front-and-back direction or the width direction of the door, and connecting stability of the first cover member and the second cover member can be enhanced.

Optionally, the first cover member or the second cover member has a bow-shaped section. In this way, multiple limits can be implemented in the front-and-back direction and the width direction of the door, and connecting stability of the first cover member and the second cover member can be enhanced.

Optionally, the at least two slots include a third slot, the at least two insert portions include a third insert portion for being inserted into the third slot, and the third insert portion includes a guide rail, where the guide rail is used to move along a pair of opposite guide walls of the third slot to guide the first cover member to be connected to the second cover member.

In this way, the guide rail and the guide walls are cooperated with each other, to achieve positioning and guiding effects to a certain extent and ensure that the first cover member and the second cover member are accurately connected, so that the multiple insert portions can be accurately inserted into the matching slots, and the first cover member and the second cover member smoothly slide against each other to be connected.

Optionally, one of the guide rail and the guide wall is provided with a hook and the other one is provided with a bayonet, and the hook is stuck in the bayonet to prevent the first cover member and the second cover member from detaching from each other along the length direction of the side cover.

Optionally, at least one of the at least two insert portions is provided with ribs at least on an inner surface, and the ribs abut against inner walls of the corresponding slots. The side cover may be used as a recessed door handle, and two opposite parts of the recessed door handle along a length are connected easily and firmly.

On the one hand, the ribs abut against the inner walls of the slots, which can prevent the first cover member and the second cover member from shaking in relation to each other; and the side cover has a compact structure and desirable stability during the assembly. On the other hand, compared with that a relatively thick insert portion is designed to enhance compactness of a structure, materials can be saved and costs can be reduced due to use of the ribs. In addition, in this way, resistance during the connection of the first cover member and the second cover member can be reduced, so that the first cover member and the second cover member can be connected quickly and smoothly.

Optionally, at least one of the first cover member and the second cover member has a handle slot.

Optionally, at least one insert portion and/or the slot are connected to an end wall of the handle slot.

The present invention further provides a door for a refrigeration appliance. The door includes a door plate and a side cover, and the side cover includes a first cover member and a second cover member bonded along a length direction of the side cover. The door includes a connecting structure for connecting the first cover member and the second cover member, and the connecting structure includes multiple slots and multiple insert portions inserted into the corresponding slots in the length direction. At least one insert portion is limited by the matching slot along a front-and-back direction of the door, and at least one insert portion is limited by the matching slot along a width direction of the door.

Optionally, the at least two slots include a third slot, the at least two insert portions include a third insert portion for being inserted into the third slot, and the third insert portion includes a guide rail, where the guide rail is used to move along a pair of opposite guide walls of the third slot to guide the first cover member to be connected to the second cover member.

Optionally, one of the guide rail and the guide wall is provided with a hook and the other one is provided with a bayonet, and the hook is stuck in the bayonet to prevent the first cover member and the second cover member from detaching from each other along the length direction of the side cover.

The present invention further provides a refrigeration appliance, where the refrigeration appliance includes the door described according to any one of the foregoing.

DETAILED DESCRIPTION

To make the foregoing objectives, features, and advantages of the present invention more obvious and more understandable, the following describes specific embodiments of the present invention in detail with reference to the accompanying drawings.

Figure 1:
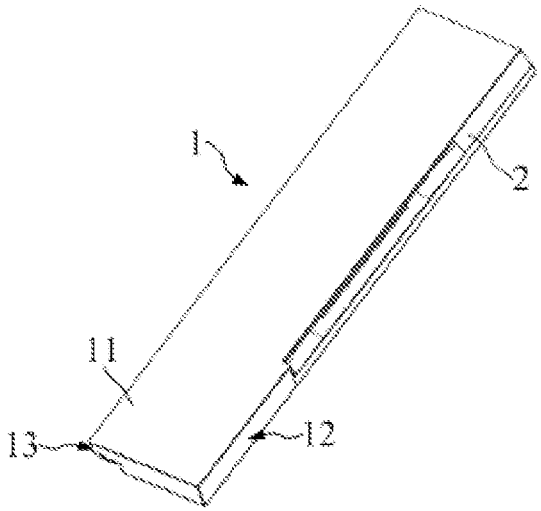
FIG. 1 is a three-dimensional view of a door according to a specific embodiment of the present invention.
Figure 2:
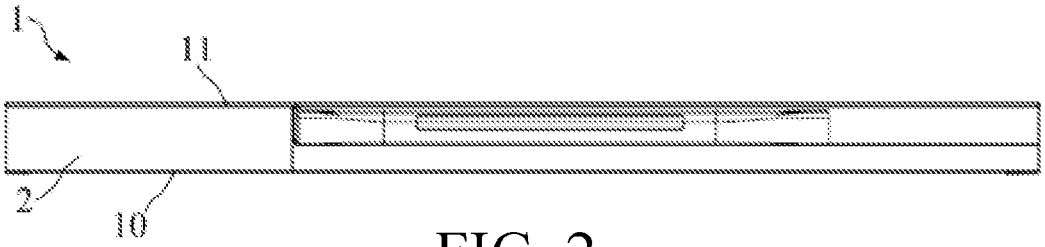
FIG. 2 is a plan view of the door from the perspective of a width direction of the door according to a specific embodiment of the present invention.

Referring to FIG. 1 and FIG. 2, a door 1 for a refrigeration appliance includes an inner door-wall 10 (not shown in FIG. 1), a door plate 11 in front of the inner door-wall 10, and a side cover 2.

Figure 3:
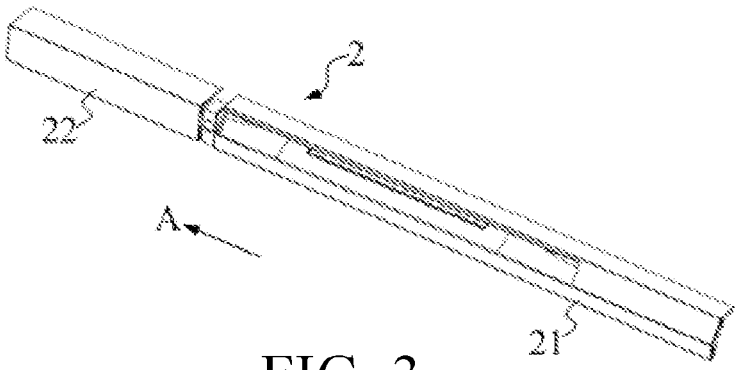
FIG. 3 is a three-dimensional view of a side cover separated from the door shown in FIG. 1.

Referring to FIG. 3, the side cover 2 includes a first cover member 21 and a second cover member 22 bonded along a length direction A of the side cover 2.

Figure 4:
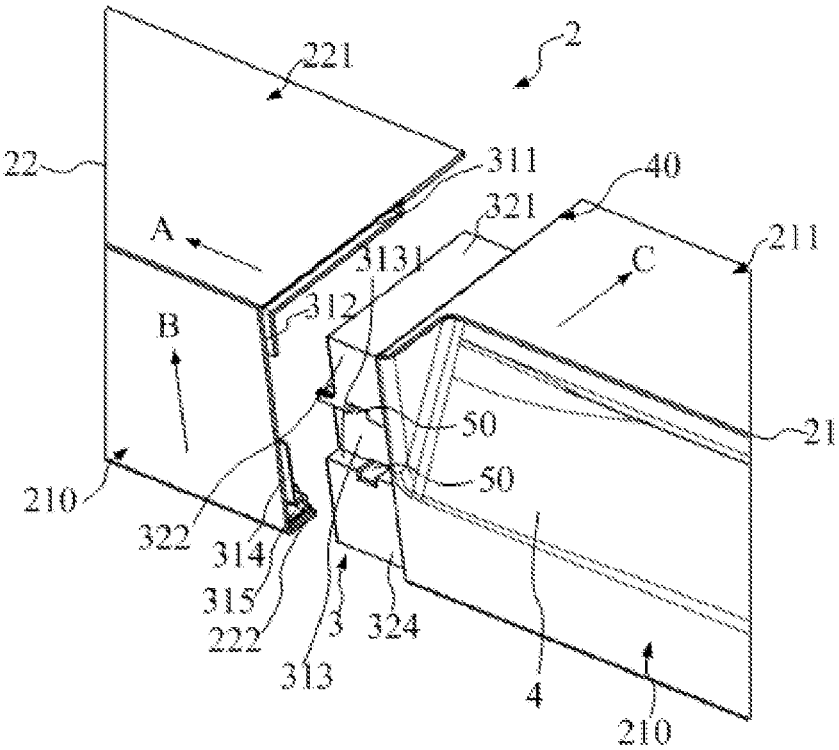
FIG. 4 is an enlarged three-dimensional view of the side cover separated from the door shown in FIG. 1.
Figure 5:
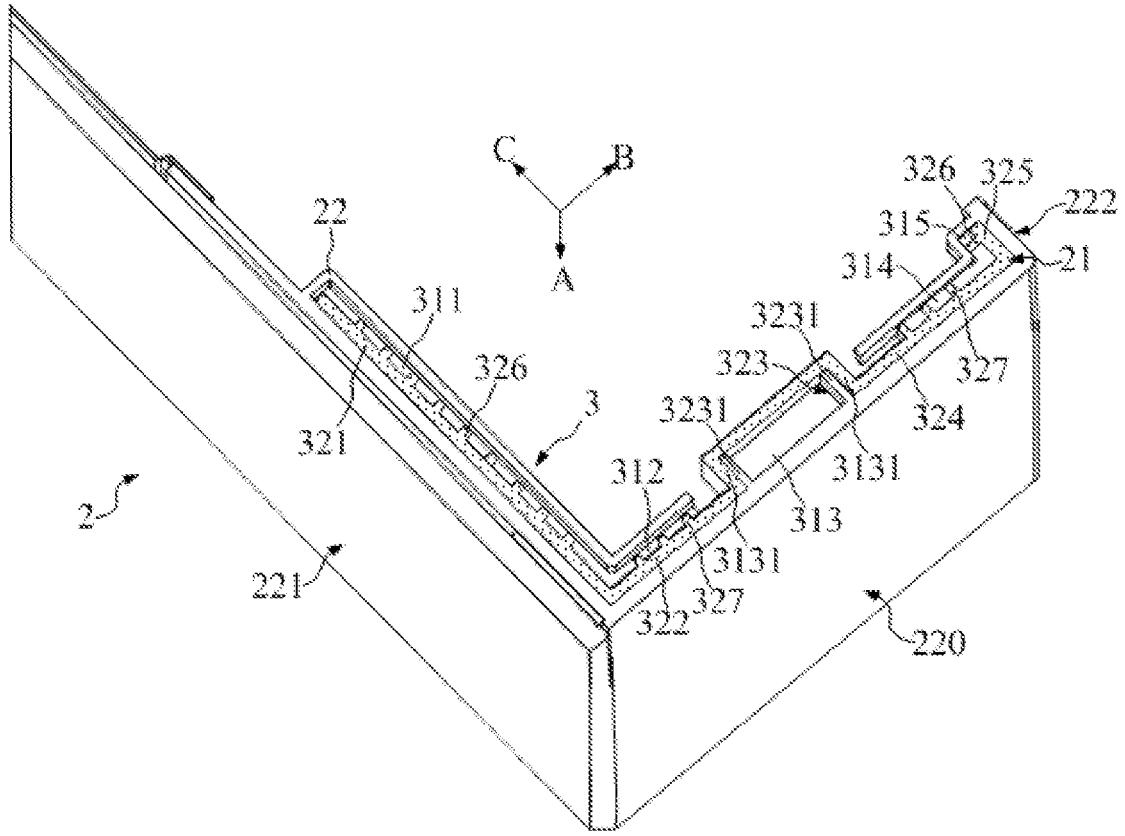
FIG. 5 is a partial cross-section view of the side cover of the door shown in FIG. 1 during assembly, where a section of the partial cross-section view is perpendicular to a length direction of the side cover.

Referring to FIG. 4 and FIG. 5, the side cover 2 may include a connecting structure 3 for connecting the first cover member 21 and the second cover member 22. The connecting structure 3 may include multiple slots and multiple insert portions inserted into the matching slots along the length direction A of the side cover 2.

The at least two insert portions include first insert portions 321 and 325 (not shown in FIG. 4) and second insert portions 322 and 324 perpendicular to each other. The first insert portions 321 and 325 are disposed parallel to each other, and therefore are both represented as the first insert portions. The second insert portions 322 and 324 are disposed parallel to each other, and therefore are both represented as the second insert portions.

Correspondingly, the at least two slots include: first slots 311 and 315 into which the first insert portions 321 and 325 are respectively inserted, and second slots 312 and 314 into which the second insert portions 322 and 324 are respectively inserted.

The first insert portions 321 and 325 are respectively into the first slots 311 and 315, and the first insert portions 321 and 325 are limited by the first slots 311 and 315 along a front-and-back direction B of the door. The second insert portions 322 and 324 are respectively inserted into the second slots 312 and 314, and the second insert portions 322 and 324 are limited by the second slots 312 and 314 along a width direction C of the door.

During assembly, the first cover member 21 and the second cover member 22 are operated to be connected by inserting the insert portions into the matching slots, and the first cover member 21 and the second cover member 22 are not readily separated in the length direction A of the side cover 2. On the one hand, the inserting manner is easy to operation, and the first cover member 21 and the second cover member 22 can be connected quickly, improving assembly efficiency.

On the other hand, the first insert portions 321 and 325 are respectively limited by the first slots 311 and 315 along the front-and-back direction B of the door. In this way, the first cover member 21 and the second cover member 22 are not prone to move in relation to each other in the front-and-back direction B of the door and are limited by each other in the front-and-back direction B. The two insert portions correspond to two limit positions in the front-and-back direction B of the door, so that connecting stability and firmness of the first cover member 21 and the second cover member 22 in the front-and-back direction B of the door can be achieved. Therefore, at least one insert portion may be disposed to be limited by the matching slot along the front-and-back direction B of the door.

The second insert portions 322 and 324 are respectively limited by the second slots 312 and 314 along the width direction C of the door. In this way, the first cover member 21 and the second cover member 22 are not prone to move in relation to each other in the width direction C of the door and are limited by each other in the width direction C. The two insert portions correspond to two limit positions in the width direction C of the door, so that connecting stability and firmness of the first cover member 21 and the second cover member 22 in the width direction C of the door can be achieved. Therefore, at least one insert portion may be disposed to be limited by the matching slot along the width direction C of the door.

Therefore, the connecting structure 3 enables the first cover member 21 and the second cover member 22 to both have desirable connecting stability and to be not prone to shake in relation to each other in the front-and-back direction B and the width direction C of the door.

It should be understood that, the length direction A of the side cover 2 is a height direction of the door when the side cover 2 extends along the height direction of the door 1 (referring to FIG. 1). In another technical solution, the length direction of the side cover is the width direction of the door when the side cover is disposed along the width direction of the door. The present invention is applied to a case in which the side cover is disposed along the width direction of the door or along the height direction of the door.

The first cover member 21 may have a handle slot 4 (not shown in FIG. 5). In this way, the side cover 2 may be used as a recessed door handle, and two opposite parts of the recessed door handle along a length are connected easily and firmly. In a feasible solution, at least one of the first cover member and the second cover member may have a handle slot.

The first insert portions 321 and 325 and the second insert portions 322 and 324 may be disposed on the first cover member 21, and may be connected to an end wall 40 of the handle slot 4. The at least two slots include a third slot 313 located between the two second insert portions 322 and 324. The third slot 313 may be connected to the end wall 40 of the handle slot 4. Therefore, in a feasible solution, one cover member may be provided with both an insert portion and a slot, and at least one insert portion and/or a slot may be connected to the end wall of the handle slot.

As an improvement, at least two first insert portions and at least two second insert portions may be disposed on the second cover member. Correspondingly, at least two first slots and at least two second slots may be disposed on the first cover member. The second cover member may include the at least two second insert portions, and a third slot may be provided between the two second insert portions. Therefore, the first cover member or the second cover member includes the at least two second insert portions, and the at least two slots include the third slot located between the at least two second insert portions.

The third slot 313 is located between the two second insert portions 322 and 324, and the third slot 313 is adjacent to both the second insert portions 322 and 324. As an improvement, a third slot is provided on the first insert portions, and the at least two slots may include the third slot adjacent to the first insert portions.

Correspondingly, the second cover member 22 has a third insert portion 323 matching the third slot 313, and the third insert portion 323 is inserted into the corresponding third slot 313. In this way, at least three limit positions can be formed in the front-and-back direction B of the door, and connecting stability of the first cover member 21 and the second cover member 22 can be enhanced.

Referring to FIG. 5, the first insert portions 321 and 325, the second insert portions 322 and 324, and the third slot 313 are connected to each other, so that the first cover member 21 has a bow-shaped section. In this way, multiple limits can be implemented in the front-and-back direction B and the width direction C of the door, and connecting stability of the first cover member 21 and the second cover member 22 can be enhanced. It can be conceived that the first cover member may also have a bow-shaped section.

Referring to FIG. 4 and FIG. 5, a pair of insert portions: the first insert portion 321 and second insert portion 322 may be connected, the first insert portion 321 is inserted into the first slot 311, and the second insert portion 322 is inserted into the second slot 312. Correspondingly, another pair of insert portions: the first insert portion 325 and second insert portion 324 may be adjacent, the first insert portion 325 is inserted into the first slot 315, and the second insert portion 324 is inserted into the second slot 314. In this way, manufacture of molds can be simplified and manufacturing efficiency can be improved.

The first cover member 21 and the second cover member 22 separately include: sidewall portions for forming corresponding parts of one sidewall 12 (with reference to FIG. 1) of the door 1, for example, the first cover member 21 includes a first sidewall portion 210 (not shown in FIG. 5) and the second cover member 22 includes a second sidewall portion 220; and connecting portions that extend towards another sidewall 13 (with reference to FIG. 1) of the door 1 and that are connected to the door plate 11 or the inner door-wall 10.

Figure 6:
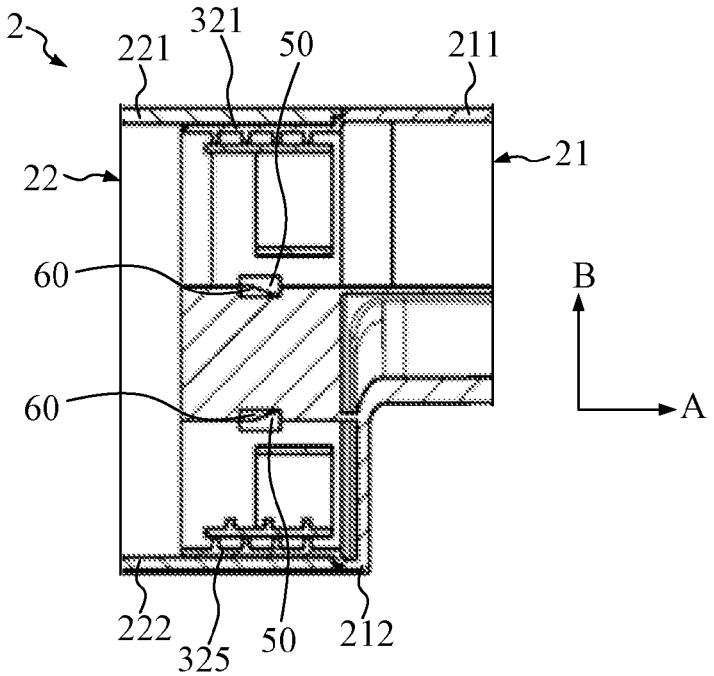
FIG. 6 to FIG. 8 are cross-section views of the side cover of the door shown in FIG. 1 at stages of an assembly process, where sections of these cross-section views are perpendicular to a width direction of the door.

With reference to FIG. 6, for example, the first cover member 21 includes first connected portions 211 and 212 (not shown in FIG. 4 and FIG. 5) disposed opposite in the front-and-back direction B of the door 1, and the second cover member 22 includes second connected portions 221 and 222 disposed opposite in the front-and-back direction B of the door 1. The first connected portions 211 and 212 are respectively parallel with the second connected portions 221 and 222. The first connected portion 211 is flush with the second connected portion 221, and the first connected portion 212 is flush with the second connected portion 222.

The first insert portions 321 and 325 are parallel to the first connected portions 211 and 212 and the second connected portions 221 and 222. The second insert portions 322 and 324 are parallel to the first sidewall portion 210 and the second sidewall portion 220. In this way, the first cover member 21 and the second cover member 22 can be limited by each other and are not prone to shake in relation to each other along the front-and-back direction B and the width direction C of the door plate. Therefore, by means of the technical solutions in the present invention, the first insert portion and the second insert portion may be respectively parallel to the sidewall portion and the connecting portions of the first cover member or visa verse.

In an optional solution, the multiple insert portions may not be parallel to one of the sidewall portion and the connected portion of the first cover member. In this case, at the premise that it is ensured that two insert portions of the multiple insert portions are disposed perpendicular to each other, there may be a certain angle between the multiple insert portions and the sidewall portions and the connected portions of the first cover member.

Referring to FIG. 5, each of inner surfaces of the first insert portions 321 and 325 is provided with several ribs arranged with an interval along the length direction A of the side cover 2. The several ribs are first ribs 326, and the first ribs 326 abut against an inner wall of the first slot 311. Each of inner surfaces of the second insert portions 322 and 324 is provided with several ribs arranged with an interval along the length direction A of the side cover 2. The several ribs are second ribs 327, and the second ribs 327 abut against an inner wall of the another first slot 315. On the one hand, in this way, the first cover member 21 and the second cover member 22 can be prevented from shaking in relation to each other; and the side cover 2 has a compact structure and desirable stability during the assembly.

On the other hand, compared with that a relatively thick insert portion is designed to enhance compactness of a structure, materials can be saved and costs can be reduced due to use of the first ribs 326 and the second ribs 327. In addition, in this way, resistance during the connection of the first cover member 21 and the second cover member 22 can be reduced, so that the first cover member 21 and the second cover member 22 can be connected quickly and smoothly.

In addition to that the ribs are provided on the multiple insert portions, as an improvement, the ribs may be provided on only one insert portion. Therefore, the ribs may be provided on at least one of the at least two insert portions.

In addition to that the ribs are provided on the inner surface of the insert portion, as an improvement, the ribs may be provided on an outer surface of the insert portion. Therefore, the insert portion may be provided with several ribs arranged with an interval along the length direction A of the side cover, and the ribs may abut against inner walls of the corresponding slots.

Referring to FIG. 5, the at least two slots include a third slot 313, the at least two insert portions include a third insert portion 323 for being inserted into the third slot 313, and the third insert portion 323 includes a guide rail 3231, where the guide rail 3231 is used to move along a pair of opposite guide walls 3131 of the third slot 313 to guide the first cover member 21 to be connected to the second cover member 22.

During assembly, the first cover member 21 and the second cover member 22 are connected. First, the guide rail 3231 is directed to the third slot 313. Then the guide rail 3231 is operated to be inserted into the third slot 313. The guide rail 3231 attaches to and slides along the corresponding guide walls 3131, to guide the first insert portions 321 and 325 to be accurately inserted into the first slots 311 and 315 respectively, and guide the second insert portions 322 and 324 to be accurately inserted into the second slots 312 and 324. The guide rail 3231 and the guide walls 3131 are cooperated with each other, to achieve positioning and guiding effects to a certain extent and ensure that the first cover member 21 and the second cover member 22 are accurately connected, so that the multiple insert portions can be accurately inserted into the matching slots, and the first cover member 21 and the second cover member 22 smoothly slide against each other to be connected.

Figure 7:
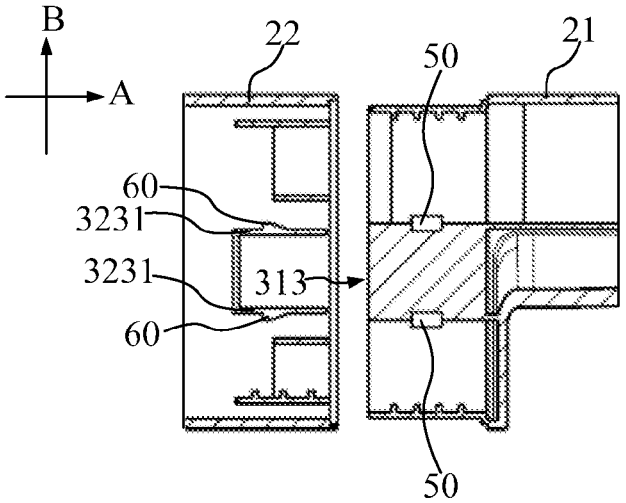

Referring to FIG. 7, the guide rail 3231 may be provided with a hook 60, and the guide wall 3131 may be provided with a bayonet 50 (with reference to FIG. 4). The hook 60 may be stuck in the bayonet 50 to prevent the first cover member 21 and the second cover member 22 from detaching from each other along the length direction A of the side cover 2.

Figure 8:
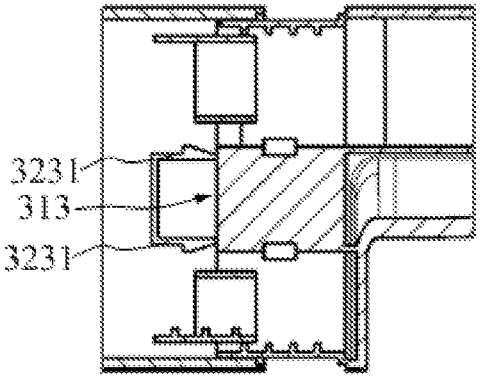

In an assembly process, the guide rail 3231 is directed to the third slot 313. Referring to FIG. 7, the guide rail 3231 enters the third slot 313. Referring to FIG. 8 and FIG. 6, when the hook 60 enters the third slot 313 (not shown in FIG. 6), the hook 60 is pressed by the guide walls 3131 (with reference to FIG. 5) to generate elastic deformation, until the hook 60 is stuck in a corresponding opening 50. Then hook 60 is recovered from the deformation, and is limited in the opening 50.

Referring to FIG. 6, the hook 60 is cooperated with the bayonet 50, which not only can enhance connecting firmness of the first cover member 21 and the second cover member 22, but also achieve a positioning effect for assembly. When the hook 60 is stuck in the bayonet 50, the hook 60 is assembled in the right place.

Referring to FIG. 7, there are a pair of guide rails 3231, which are disposed opposite to each other along the front-and-back direction of the door. Each guide rail 3231 is provided with a hook 60. Therefore, with reference to FIG. 6, there are a pair of hooks 60, which are disposed away from each other along the front-and-back direction B of the door. Correspondingly, there are a pair of bayonets 50, which are disposed opposite to each other along the front-and-back direction B of the door. The hooks 60 is stuck in the corresponding bayonets 50. In this way, connecting stability of the first cover member 21 and the second cover member 22 can be further enhanced.

As an improvement, the guide rail may be provided with a bayonet, and the guide wall may be provided with a hook. Therefore, it can be conceived that one of the guide rail and the guide wall may be provided with a hook and the other one is provided with a bayonet, and the hook is stuck in the bayonet to prevent the first cover member and the second cover member from detaching from each other along the length direction of the side cover.

Although the present invention is disclosed above, the present invention is not limited thereto. Any person skilled in the art can make various changes and modifications, without departing from the spirit and the protection scope of the present invention. Therefore, the protection scope of the present invention should depend on what is defined by the scope of claims.

What is claimed is:

1. A door for a refrigeration appliance, the door comprising:

an inner door-wall and a door plate in front of said inner door-wall;

a side cover having a first cover member and a second cover member bonded along a length direction of said side cover;

a connecting structure connecting said first cover member and said second cover member, said connecting structure being formed with at least two slots and at least two insert portions for insertion into respectively matching said slots in the length direction of said side cover; and said at least two insert portions including a first insert portion and a second insert portion perpendicular to said first insert portion, said first insert portion and said second insert portion connected to one another and being inserted into a first slot and a second slot respectively; and said first slot and said second slot being in communication with one another and perpendicular to each other.

2. A door for a refrigeration appliance, the door comprising:

a door plate and a side cover;

said side cover including a first cover member and a second cover member bonded along a length direction of said side cover;

a connecting structure for connecting said first cover member and said second cover member, said connecting structure including at least two slots and at least two insert portions inserted into corresponding said slots in the length direction of said side cover; and said at least two insert portions comprising a first insert portion and a second insert portion, said first insert portion being limited by the corresponding said slot along a front-and-back direction of the door, and said second insert portion being limited by the corresponding said slot along a width direction of the door.

3. The door according to claim 2, wherein:

said first cover member and said second cover member separately comprise sidewall portions for forming corresponding parts of one sidewall of the door and connecting portions that extend towards another sidewall of the door and that are connected to said door plate or said inner door-wall; and said first insert portion and said second insert portion are respectively parallel to said sidewall portion and said connecting portions of said first cover member.

4. The door according to claim 2, wherein:

said first insert portion and said second insert portion are connected to one another and are inserted into a first slot and a second slot respectively; and said first slot and said second slot are in communication with one another and perpendicular to each other.

5. The door according to claim 2, wherein said at least two slots are at least three slots including a third slot adjacent said first insert portion or said second insert portion.

6. The door according to claim 2, wherein said first cover member or said second cover member comprises at least two second insert portions, and said at least two slots are at least three slots including a third slot located between said at least two second insert portions.

7. The door according to claim 6, wherein said first cover member or said second cover member has a bow-shaped section.

8. The door according to claim 2, wherein:

said at least two slots are at least three slots including a third slot;

said at least two insert portions are at least three insert portions including a third insert portion to be inserted into said third slot; and said third insert portion includes a guide rail configured to move along a pair of opposing guide walls of said third slot to guide said first cover member to be connected to said second cover member.

9. The door according to claim 8, wherein one of said guide rail or said guide wall is formed with a hook and the respectively other of said guide rail or said guide wall is formed with a bayonet, and said hook engages in said bayonet to prevent a detachment of said first cover member from said second cover member along the length direction of said side cover.

10. The door according to claim 2, wherein at least one of said at least two insert portions is formed with ribs at least on an inner surface thereof, and said ribs abut against inner walls of corresponding said slots.

11. The door according to claim 2, wherein at least one of said first cover member and said second cover member is formed with a handle slot.

12. The door according to claim 11, wherein said handle slot has an end wall, and at least one said insert portion and/or said slot are connected to said end wall of said handle slot.

13. A refrigeration appliance, comprising a door according to claim 2.

14. The door according to claim 2, wherein:

said at least two slots are at least three slots including a third slot;

said at least two insert portions are at least three insert portions including a third insert portion to be inserted into said third slot; and said third insert portion is formed with a guide rail configured to move along a pair of opposite guide walls of said third slot to guide said first cover member to be connected to said second cover member.

15. The door according to claim 14, wherein one of said guide rail or said guide wall formed with a hook and the respectively other of said guide rail or said guide wall is formed with a bayonet, and said hook engages in said bayonet to prevent a detachment of said first cover member from said second cover member along the length direction of said side cover.

16. A refrigeration appliance, comprising a door according to claim 2.

17. A door for a refrigeration appliance, the door comprising:

an inner door-wall and a door plate in front of said inner door-wall;

a side having a first cover member and a second cover member bonded along a length direction of said side cover, at least one of said first cover member and said second cover member being formed with a handle slot;

a connecting structure connecting said first cove member and said second cover member, said connecting structure being formed with at least two slots and at least two insert portions for insertion into respectively matching said slots in the length direction of said side cover; and said a least two insert portions including a first insert portion and a second insert portion perpendicular to said first insert portion.

* * * * *